US009447795B2

(12) United States Patent
Allan

(10) Patent No.: US 9,447,795 B2
(45) Date of Patent: Sep. 20, 2016

(54) FLUID PUMPING SYSTEM AND A FLUID TURBINE SYSTEM INCLUDING THE FLUID PUMPING SYSTEM

(71) Applicant: United Arab Emirates University, Al-Ain (AE)

(72) Inventor: Fathi M. Allan, Al-Ain (AE)

(73) Assignee: UNITED ARAB EMIRATES UNIVERSITY, Al-Ain, Abu Dhabi (AE)

( * ) Notice: Subject to any disclaimer, the term of this patent is extended or adjusted under 35 U.S.C. 154(b) by 460 days.

(21) Appl. No.: 13/913,733

(22) Filed: Jun. 10, 2013

(65) Prior Publication Data

US 2014/0363312 A1 Dec. 11, 2014

(51) Int. Cl.

| | |
|---|---|
| ***F04F 1/06*** | (2006.01) |
| ***F04F 5/20*** | (2006.01) |
| ***F04F 5/52*** | (2006.01) |
| ***F04F 3/00*** | (2006.01) |

(52) U.S. Cl.
CPC . *F04F 1/06* (2013.01); *F04F 3/00* (2013.01); *F04F 5/20* (2013.01); *F04F 5/52* (2013.01)

(58) Field of Classification Search
CPC ..... F04F 1/06; F04F 3/00; F04F 1/02
See application file for complete search history.

(56) References Cited

U.S. PATENT DOCUMENTS 3,898,017 A * 8/1975 Mandroian ..... F04B 19/24 417/209
4,390,323 A 6/1983 Burnham
6,264,434 B1 * 7/2001 Frank ..... F04F 1/02 417/130
7,021,900 B2 * 4/2006 Prueitt ..... F04F 7/02 417/137
2007/0107718 A1 * 5/2007 Filippone ..... F03G 6/00 126/569

OTHER PUBLICATIONS

International Search Report for International Application No. PCT/IB2014/062078, with a mailing date of Oct. 20, 2014.

* cited by examiner

*Primary Examiner* — Bryan Lettman
(74) *Attorney, Agent, or Firm* — Katten Muchin Rosenman LLP

(57) ABSTRACT

Fluid pumping system and method comprise a pumping chamber with inlet and outlet ports. The pumping chamber is in thermal communication with a thermal system for alternating the gas temperature inside the pumping chamber between heated and cooled states. A first valve controls a first fluid communication between the pumping chamber and the external environment, and a second valve controls a second fluid communication between the pumping chamber and the fluid container. The pumping chamber and the valves cooperate to generate a vacuum and a negative potential pressure of the gas inside the pumping chamber by the effect of the gas temperature alternation when the gas passes from a heated state to a cooled state and by controlling the first and second fluid communications. The generated vacuum and negative potential pressure inside the pumping chamber enable pumping of the fluid from the fluid container inside the pumping chamber.

10 Claims, 7 Drawing Sheets

FLUID PUMPING SYSTEM AND A FLUID TURBINE SYSTEM INCLUDING THE FLUID PUMPING SYSTEM

FIELD OF INVENTION

This invention relates to a fluid pumping system, to a method of pumping fluid, to a water turbine system and to a method of generating energy using a water turbine.

BACKGROUND OF THE INVENTION

Man is trying to make active use of the different sources of renewable energy at all times: The solar energy, for example, is used in water heating, cooking, and in greenhouses to help to grow food, and of course to extract electrical energy using photovoltaic cells.

The second example of renewable energy is the wind energy. It is used to generate mechanical power or electricity using the wind turbines. The wind turbines convert the kinetic energy in the wind into mechanical power which in turn can be used to generate electricity to power homes, businesses, school, etc.

The third example of renewable energy is the hydropower energy, where the kinetic energy in the water such as dams, waterfalls and rivers can be used to generate electricity. Other examples of renewable energy resources are the biomass and bio-fuel energy, and the geothermal energy.

Nowadays, researchers are trying to combine different energy resources to maximize the benefits of these resources. For example, the solar tower which was first suggested by Isidoro Cabanyes from Spain in 1903, combines the chimney effect, the greenhouse effect and the wind turbine to maximize the use of the solar energy. It is designed to use the solar energy to generate a wind tunnel where a wind turbine can be placed to generate electricity.

It is well known that water is about 800 times denser than air, even a slow flowing stream of water can yield considerable amounts of energy. Therefore, it is very important to maximize the use of water energy whenever it is possible. The suggested design is meant to maximize the use of the water energy by creating an artificial flow stream by lifting the water above the ground level and reuse its kinetic energy to generate electricity.

The major problem facing this idea is how to lift the water or how to pump it up at a very low or at no cost. People are using the standard hydraulic pumps to lift the water but then the energy generated by the falling water will be used by this pump and make it of no use.

SUMMARY OF THE INVENTION

It is therefore an object of the present invention to provide a fluid pumping system, a method of pumping fluid, a water turbine system and to a method of generating energy using a water turbine that overcome the above mentioned drawbacks.

As a first aspect of the invention, there is provided a fluid pumping system comprising:

a pumping chamber containing gas and having a first inlet port adapted to be in fluid communication with an external environment and a first outlet port adapted to be in fluid communication with a fluid container from which fluid is to be pumped into the pumping chamber, wherein the pumping chamber is further adapted to be in thermal communication with a thermal system for alternating the gas temperature inside the pumping chamber between a heated state and a cooled state;

a first valve adapted to control a first fluid communication between the pumping chamber and the external environment; and a second valve adapted to control a second fluid communication between the pumping chamber and the fluid container;

wherein the pumping chamber and the valves are in fluid cooperation for generating a vacuum and a negative potential pressure of the gas inside the pumping chamber by the effect of the gas temperature alternation when the gas passes from a heated state to a cooled state and the controlling of the first and second fluid communications, wherein the generated vacuum and negative potential pressure inside the pumping chamber enables pumping of the fluid from the fluid container inside the pumping chamber.

As a further aspect of the invention, there is provided a method of pumping fluid from a fluid container using a pumping chamber in thermal communication with a thermal system and in fluid communications with an external environment and the fluid container, the method comprising: pumping water from the fluid container inside the pumping chamber by generating a vacuum and a negative potential pressure of gas inside the pumping chamber by alternating the gas temperature inside the pumping chamber between a heated state and a cooled state using the thermal system and by controlling the fluid communications between the pumping chamber, the external environment and the fluid container.

Preferably, the gas temperature alternation process is conducted recursively through time.

Preferably, the first valve is a one-way valve adapted to operate automatically under the effect of pressure and to open only when the pressure inside the pumping chamber exceeds the pressure of the external environment for enabling the fluid communication of gas from the pumping chamber through the first outlet port to the external environment; and the second valve is a one-way valve adapted to operate automatically under the effect of pressure and to open only when the pressure inside the pumping chamber is below the pressure of the external environment for enabling the fluid communication of fluid from the fluid container to the pumping chamber through the first inlet port filling in the generated vacuum.

The external environment can be an external chamber or the atmosphere.

Preferably, the thermal system comprises a solar thermal system. The thermal system can alternatively or additionally comprise an electrical thermal system or any other thermal system using an alternative source of energy.

The fluid pumping system preferably further comprises a temperature gauge adapted to operate at a pre-set temperature for releasing heat from inside the pumping chamber for cooling down the gas when the pre-set temperature is reached inside the pumping chamber.

Preferably, the pumping chamber has a second outlet port in fluid communication with a third conduit for exhausting the pumped fluid from inside the pumping chamber for external use, the system preferably further comprising a pressure gauge for adjusting the pressure inside the pumping chamber during the exhaustion process, a fluid flow switch for regulating the flow of fluid being exhausted and an air flow switch for inducing air inside the pumping chamber for facilitating the fluid exhaustion process.

The fluid pumping system preferably further comprises a first conduit adapted to be connected to the first outlet port and to the external environment for transporting the gas from the pumping chamber to the external environment.

The fluid pumping system preferably further comprises a second conduit adapted to be connected to the first inlet port and to the fluid container for transporting the fluid from the fluid container to the pumping chamber.

As a another aspect of the invention, there is provided a water turbine system for generating energy comprising, in combination:

a water turbine for generating energy; and a pumping system in accordance with this invention;

wherein the pumping chamber of the pumping system is further adapted to be in fluid communication with the water turbine for directing water pumped from the fluid container to the water turbine for operation.

As a further aspect of the invention, there is provided a method of generating energy using a water turbine, the method comprising using the method of pumping water from a fluid container as claimed in any one of claims 12 to 15 for pumping water from the fluid container for operating the water turbine for generating energy.

Further advantages of the invention will become apparent from the drawings and the following description.

BRIEF DESCRIPTION OF THE DRAWINGS

The invention will now be described by way of example only, with reference to the accompanying drawings, in which.

DETAILED DESCRIPTION OF THE INVENTION

Figure 1:
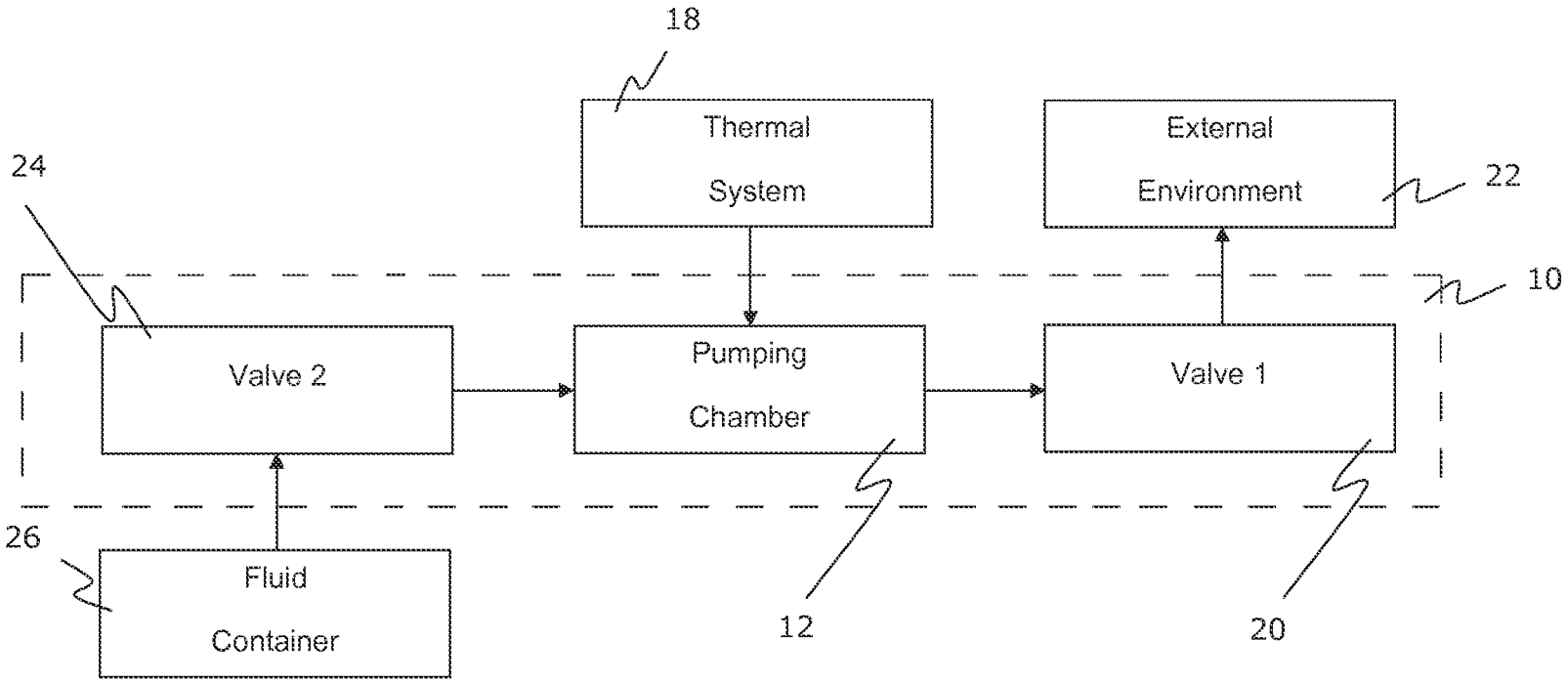
FIG. 1 is a bloc diagram showing the fluid pumping system in accordance with one embodiment of the present invention.
Figure 2:
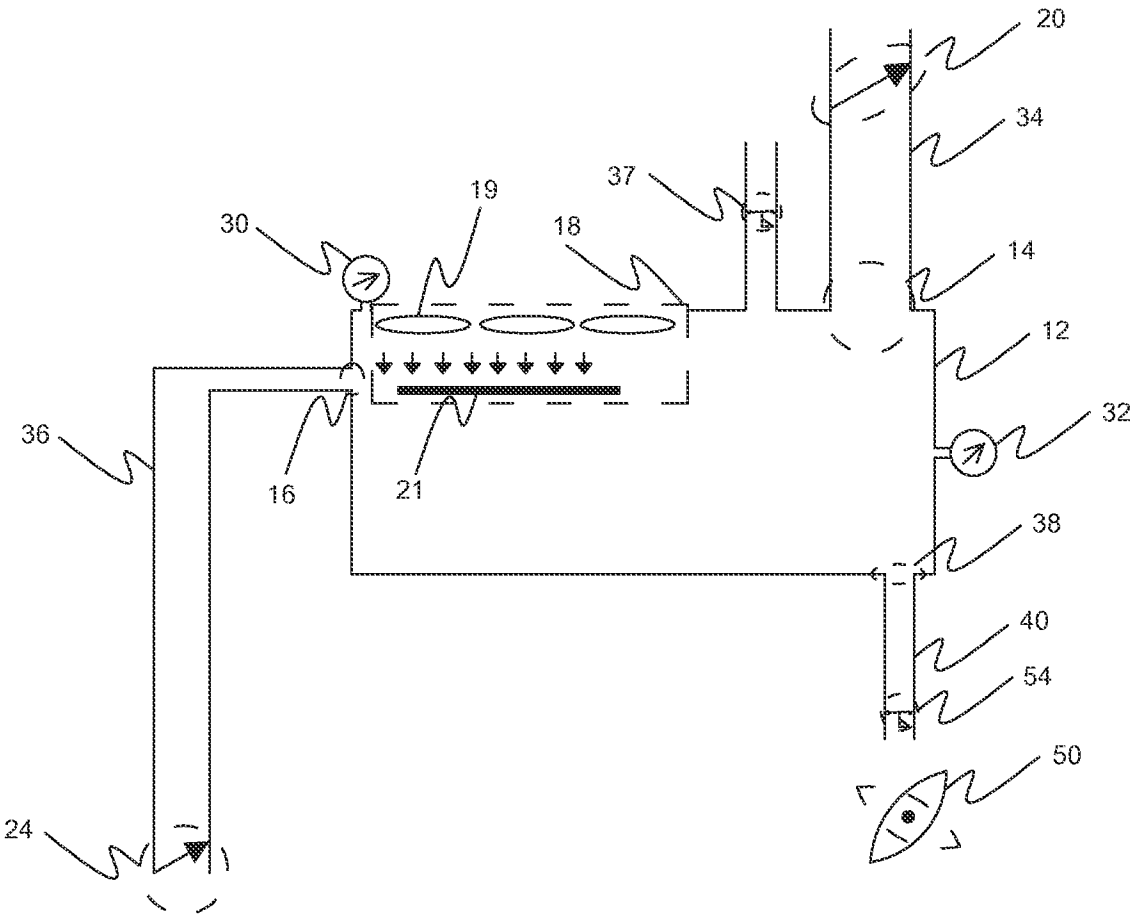
FIG. 2 is a schematic view showing the main components of the fluid pumping system in accordance with one embodiment of the invention.

Referring to FIGS. 1 and 2, there is provided a fluid pumping system 10 comprising a pumping chamber 12, a first valve 20 and a second valve 24. The pumping chamber 12 contains gas (e.g. air) and has a first outlet port 14 adapted to be in fluid communication with an external environment 22 and a first input port 16 adapted to be in fluid communication with a fluid container 26 from which fluid 40 is to be pumped into the pumping chamber 12. The pumping chamber 12 is further adapted to be in thermal communication with a thermal system 18 for alternating the gas temperature inside the pumping chamber between a heated state and a cooled state.

The fluid 40 to be pumped from the fluid container 26 can be gas or liquid such as water, oil, natural gas and the like. The fluid container 26 can be any type of fluid container and can be over ground, underground or submarine. For example, the fluid container 26 can be a lake where the lake water can be pumped using the system 10 into the pumping chamber 12. The fluid container 26 can also be an oil and/or gas field (underground or submarine) where oil/gas is to be pumped from under the ground/under the water into the pumping chamber 12.

The pumping chamber 12 is in thermal communication with the thermal system 18 for alternating the gas temperature inside the pumping chamber 12 between a heated state and a cooled state.

The first valve 20 is adapted to control a first fluid communication between the pumping chamber 12 and the external environment 22. The first fluid communication is essentially a gas communication where the heated gas inside the pumping chamber 12 flows towards the external environment 22 via the first valve 20. The second valve 24 is adapted to control a second fluid communication between the pumping chamber 12 and the fluid container 26. The second fluid communication can be liquid or gas, depends on the nature of the fluid 40 to be pumped.

Figure 3A:
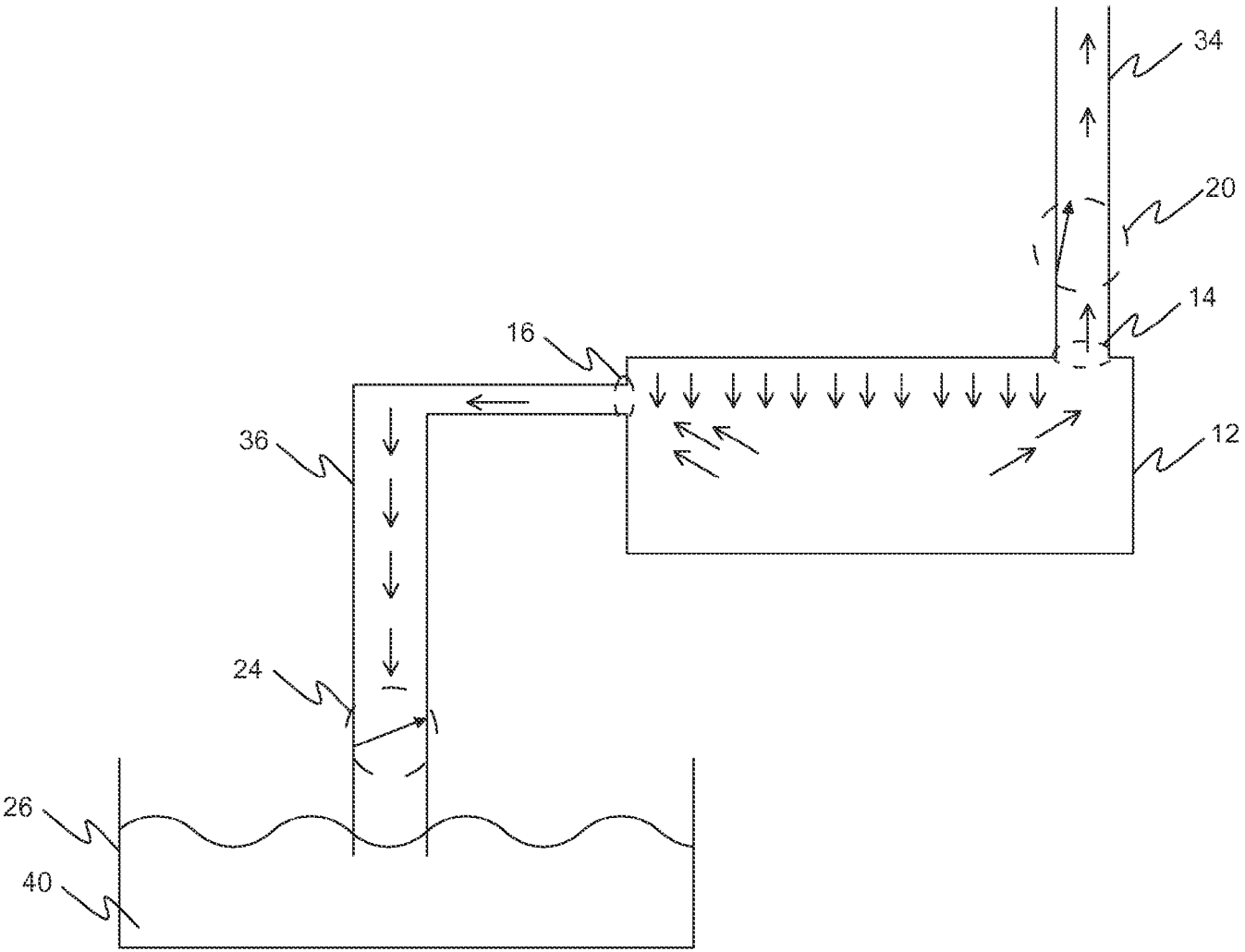
FIG. 3A is a schematic view showing the fluid pumping system during the heating stage.

The thermal system 18 is adapted to heat the gas inside the pumping chamber 12 which will result in the increase of pressure inside the pumping chamber 12. FIG. 3A shows the pumping system during the heating stage. When the pressure inside the pumping chamber 12 exceeds the pressure of the external environment 22, the first valve 20 will open to direct the heated gas to the external environment 22 which will result in the decrease of the gas mass and stabilization of the pressure inside the pumping chamber 12.

Figure 3B:
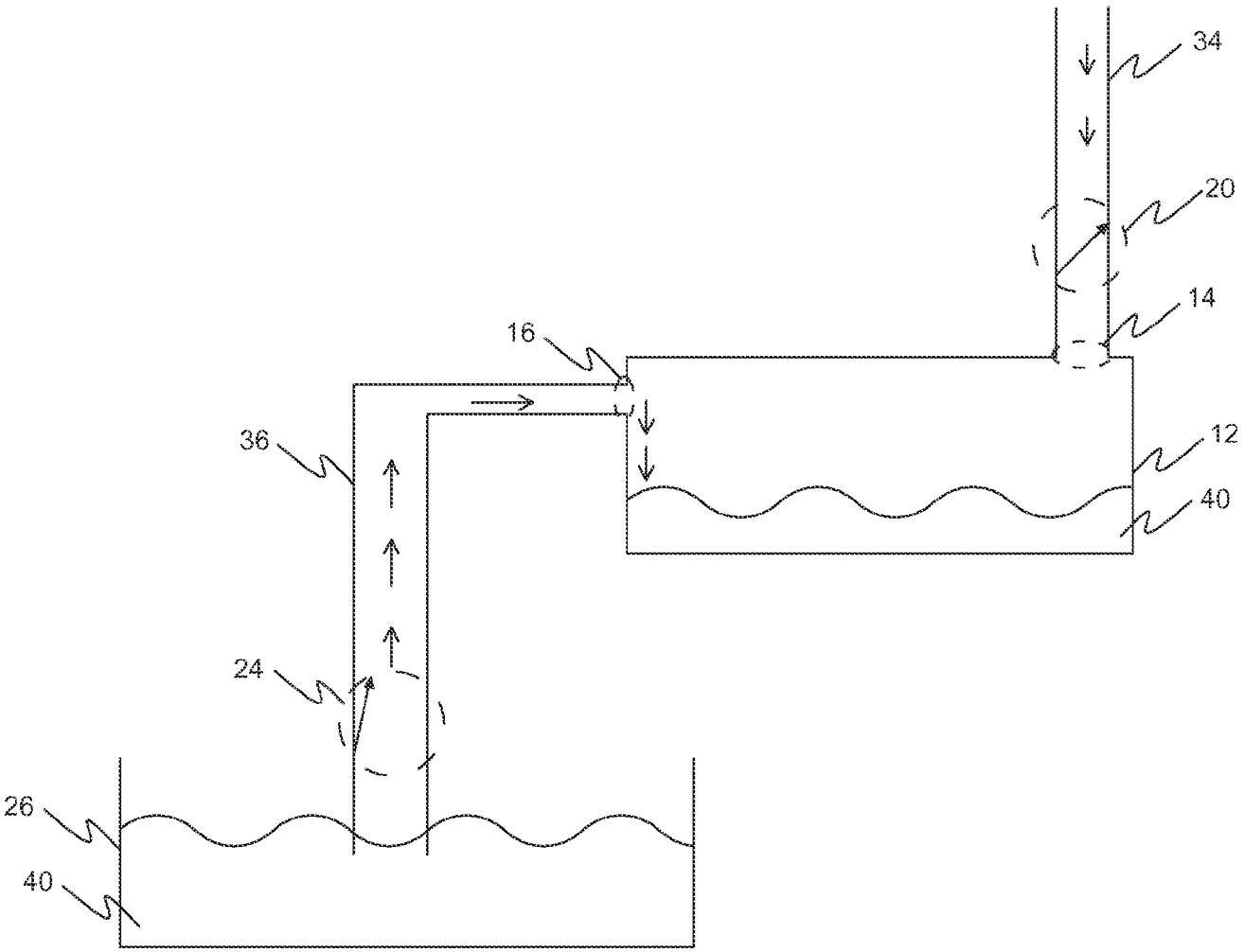
FIG. 3B is a schematic view showing the fluid pumping system during the cooking stage.

The gas inside the pumping chamber 12 is then cooled down which will result in the decrease of pressure and the generation of a negative pressure potential and a vacuum inside the pumping chamber 12. FIG. 3B shows the pumping system during the cooling stage. The generated negative potential pressure and vacuum inside the pumping chamber 12 forces the second valve 24 to open by the difference of pressure between the pumping chamber 12 and the fluid container 26, therefore inducing the fluid 40 of the container fluid 26 to be pumped into the pumping chamber 12 to fill up the vacuum.

The pumping process of the fluid 40 can be repeated recursively over time by continuously reheating the gas inside the pumping chamber 12 and letting it cool down until a negative potential pressure and a vacuum are regenerated which will result in subsequent pumping of the fluid 40 inside the pumping chamber 12. Each round of gas temperature alternation inside the pumping chamber 12 will result in a new round of pumping fluid 40 from the fluid container 26 inside the pumping chamber 12. This is because each round of gas temperature alternation between a heated state and a cooled state results in the generation of negative pressure potential and a vacuum inside the pumping chamber 12, therefore resulting in the pumping of water from the fluid container 26 into the pumping chamber 12.

The thermal system 18 can be of any suitable type, such as a solar thermal system, an electrical thermal system or a natural gas thermal system. The thermal system comprises at the least a heating device for hearing the gas inside the pumping chamber 12.

The thermal system 18 however can further comprise a cooling device for cooling down the gas after heating. The time delay between the heating and cooling processes can be configured based on the circumstances of each case, taking into consideration for example the volume of the pumping chamber 12, the type of gas inside the pumping chamber 12, the negative potential pressure required to induce the second valve 24 to be opened and to pump the fluid 40 from the fluid container 26 inside the pumping chamber 12, the nature of the fluid 40 (e.g. density) and the normal pressure of the external environment 22.

Alternatively, when the thermal system does not comprise a cooling device for cooling down the heat of the gas inside the pumping chamber 12, the cooling process should be cooled down in an alternative manner. The cooling down of the gas inside the pumping chamber 12 can be conducted in different manners depending on the type of the thermal system and/or the environment where the fluid pumping system 10 is located.

For example, when the thermal system is a passive solar thermal system, the heating process is triggered automatically by the natural heat of the sun (e.g. during the day time) and is stopped automatically by the decrease of the natural heat of the sun (e.g. during night time). Where the temperature of the external environment 22 is lower than the temperature of the pumping chamber 12, heat will be transferred from inside the pumping chamber 12 to the external environment 22 resulting in cooling down the heat of the gas inside the pumping chamber 12. Therefore, halting the heating process inside the pumping chamber 12 will automatically result in cooling down the temperature of the gas inside the pumping chamber 12 after a certain time delay. The thermal system 18 can comprise a solar panel 19 at the wall of the pumping chamber 12 for direct exposure to a sun source (e.g. atmosphere) and in thermal communication with a black body 21 located inside the pumping chamber 12.

In another example, when the thermal system 18 is an electrical or natural gas thermal system, the heating process is adapted to be triggered and stopped according to a predetermined timeframe in such a manner that the gas is heated first and subsequently left for cooling by the effect of heat transfer between the pumping chamber 12 and the external environment 22. The heat transfer between the pumping chamber 12 and the external environment 22 can be conducted through the walls of the pumping chamber 12 which are in communication with the external environment 22.

In order to accelerate the heat transfer between the pumping chamber 12 and the external environment 22, there is provided a temperature gauge 30 in thermal communication between the pumping chamber 12 and the external environment 22 adapted to operate at a pre-set temperature for transferring heat from inside the pumping chamber 12 to the external environment 22 for cooling down the gas when the pre-set temperature is reached inside the pumping chamber 12. The temperature gauge can therefore allow in reducing the timeframe of the gas alternation process, thus resulting in increasing the fluid pumping rounds from the fluid container 26 inside the pumping chamber 12 in a given period of time.

The pumping chamber 12 and the valves 20 and 24 are in fluid cooperation for generating the vacuum and the negative potential pressure of the gas inside the pumping chamber 12 by the effect of the gas temperature alternation when the gas passes from a heated state to a cooled state and the controlling of the first and second fluid communications. Accordingly, the first valve 20 is adapted to open only when the pressure inside the pumping chamber 12 exceeds the pressure of the external environment 22 for directing a flow of gas from the pumping chamber 12 to the external environment 22. The first valve 20 remains open until the pressure inside the pumping chamber 12 is equalized with the pressure of the external environment 22. The opening of the first valve 20 results in the transfer of a mass of the heated gas from inside the pumping chamber 12 to the external environment 22, therefore generating a vacuum of mass inside the pumping chamber 12. The first valve 20 closes when the pressure inside the pumping chamber 12 is equal to or below the pressure of the external environment 22 in order to prevent any fluid communication from the external environment 22 inside the pumping chamber 12. When the temperature of the gas inside the pumping chamber 12 is subsequently cooled down, a negative potential pressure is generated inside the pumping chamber 12. The second valve 24 is adapted to open when the vacuum and negative potential pressure is generated inside the pumping chamber 12 for directing the fluid 40 from the fluid container 26 inside the pumping chamber 12. The second valve 24 remains closed if otherwise to prevent any fluid transfer from the pumping chamber 12 in the direction of the fluid container 26.

The generated vacuum and negative potential pressure inside the pumping chamber enables pumping of the fluid 40 from the fluid container 26 inside the pumping chamber 12.

The first valve 20 can be a one-way valve adapted to operate automatically under the effect of pressure and to open only when the pressure inside the pumping chamber 12 exceeds the pressure of the external environment 22 for enabling the fluid communication of gas from the pumping chamber 12 through the first outlet port 14 to the external environment 22.

The first valve 20 can therefore be a mechanical valve which operates mechanically systematically without any source of energy by the effect of pressure difference between the pumping chamber 13 and the external environment 22. Though, is type would be the most cost/energy efficient manner of implementing the first valve 20, a person skilled in the art would appreciate that the first valve 20 can be any type of valve adapted to perform the fluid communication process and fluid cooperation explained above. For example, the first valve 20 can be an electrical valve operable by cooperation with a pressure sensor to detect the pressure inside the pumping chamber 12.

The second valve 24 can, similarly to the first valve 20, be a one-way valve adapted to operate automatically under the effect of pressure and to open only when the pressure inside the pumping chamber 12 is below the pressure of the fluid container 26 for enabling the fluid communication of fluid 40 from the fluid container 26 to the pumping chamber 12 through the first inlet port 24 filling in the generated vacuum. This is because the pressure of the fluid container 26 is generally equal or higher to the pressure of the external environment 22.

The external environment 22 can be the atmosphere or an external chamber. In the latter case, the external chamber can have a bigger volume than the volume of the pumping chamber 12 in order to produce the desired pressure relationship with the pumping chamber 12 during the gas temperature alternation process.

The fluid pumping system 10 further comprises a first conduit 34 adapted to be connected to the first outlet port 14 and to the external environment 22 (e.g. atmosphere or external chamber) for transporting the gas from the pumping chamber 12 to the external environment 22.

The fluid pumping system 10 further comprises a second conduit 36 adapted to be connected to the first inlet port 16 and to the fluid container 26 for transporting the fluid 40 from the fluid container 26 to the pumping chamber 12. The second conduit 36 can be of the form of a pipeline or any other suitable form depending on the nature of the fluid container 26 and the distance between the pumping chamber 12 and the fluid container 26.

The fluid pumping system 10 also comprises a second outlet port 38 in fluid communication with a third conduit 39 for exhausting the fluid 40 from the pumping chamber 12 for external use. The fluid pumping system 10 can also comprise a pressure gauge 32 for adjusting the pressure inside the pumping chamber 12 to allow the fluid to flow through the third conduit 39 smoothly during the exhaustion process and an air flow switch 37 for inputting air inside the pumping chamber 12 from the external environment 22 for preventing any kind of discontinuity in the flow of fluid leaving the pumping chamber 12. The fluid pumping system 10 can further comprise a water flow switch 54 for controlling/regulating the flow of fluid during the exhaustion process.

Figure 4:
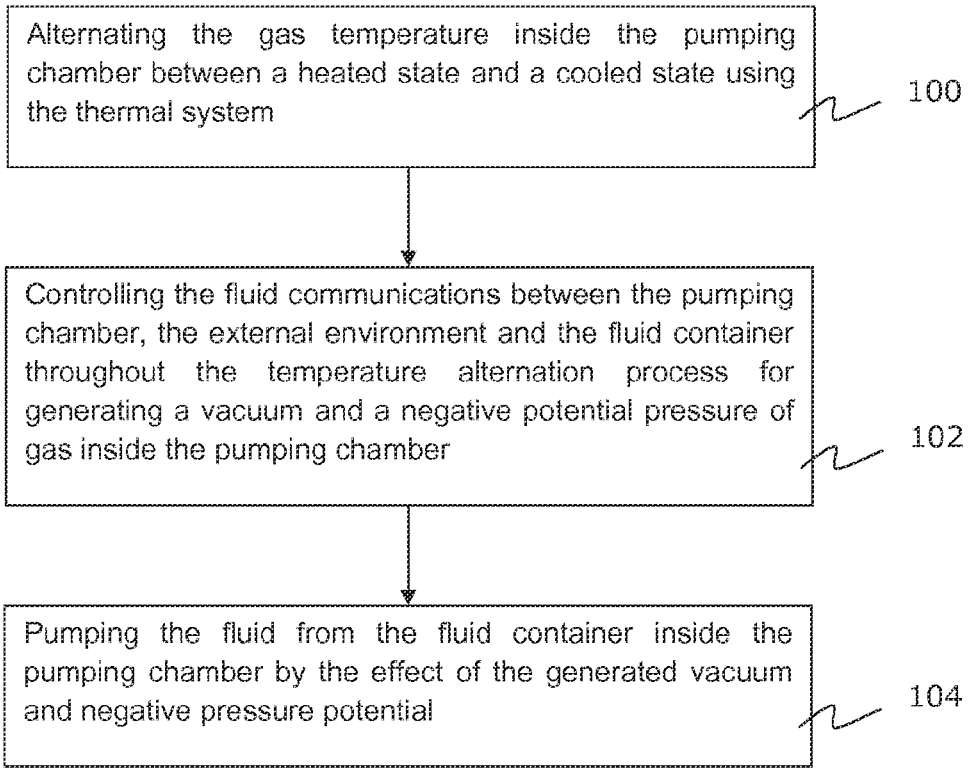
FIG. 4 is a flow chart showing a method of pumping fluid in accordance with one embodiment of the invention.

Referring to FIG. 4, there is provided a method of pumping fluid from a fluid container using a pumping chamber in thermal communication with a thermal system 18 and in fluid communications with an external environment 22 and the fluid container 26, the method comprising: alternating the gas temperature inside the pumping chamber between a heated state and a cooled state using the thermal system 100, generating a vacuum and a negative potential pressure of gas inside the pumping chamber by the effect of the gas temperature alternation and by controlling the fluid communications between the pumping chamber, the external environment and the fluid container 102, and pumping fluid from the fluid container inside the pumping chamber by the effect of the generated vacuum and negative pressure potential 104.

The generation of the vacuum and negative potential pressure inside the pumping chamber 12 as well as the controlling of the fluid communications can be carried out using the fluid pumping system explained above or any other suitable system.

Figure 5:
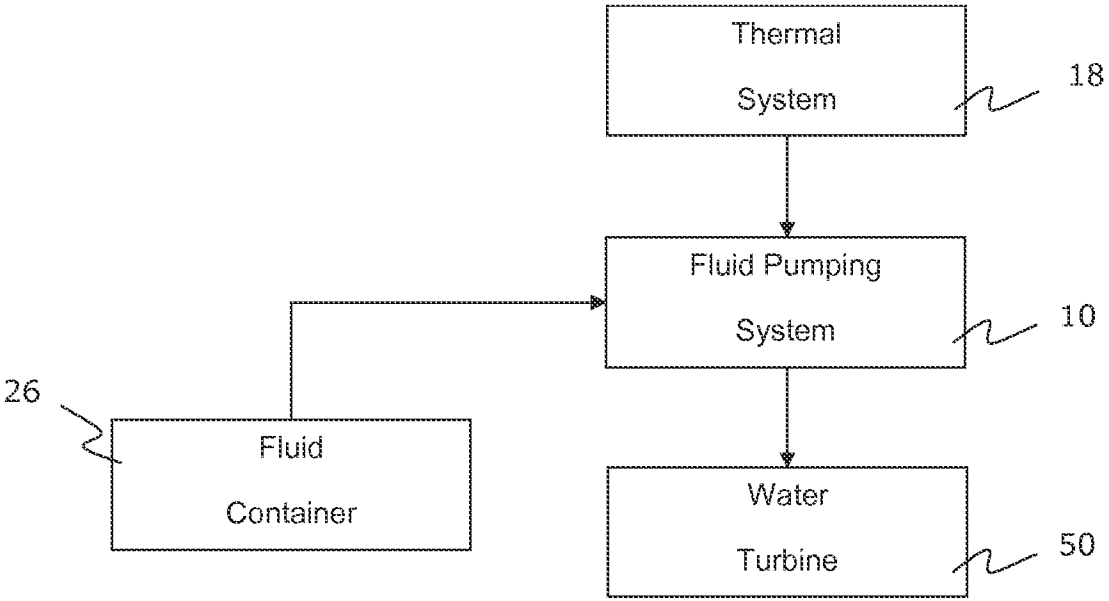
FIG. 5 is a bloc diagram showing the fluid pumping system in fluid communication with a water turbine for generating energy.

Referring to FIG. 5, there is provided a fluid turbine system for generating energy comprising, in combination:

a water turbine 50 for generating energy; and a fluid pumping system 10 in accordance with the present invention;

wherein the pumping chamber 12 of the fluid pumping system 10 is further adapted to be in fluid communication with the water turbine 50 for directing fluid 40 pumped from the fluid container 26 to the water turbine 50 for operation, the fluid 40 being water in this case.

Figure 6:
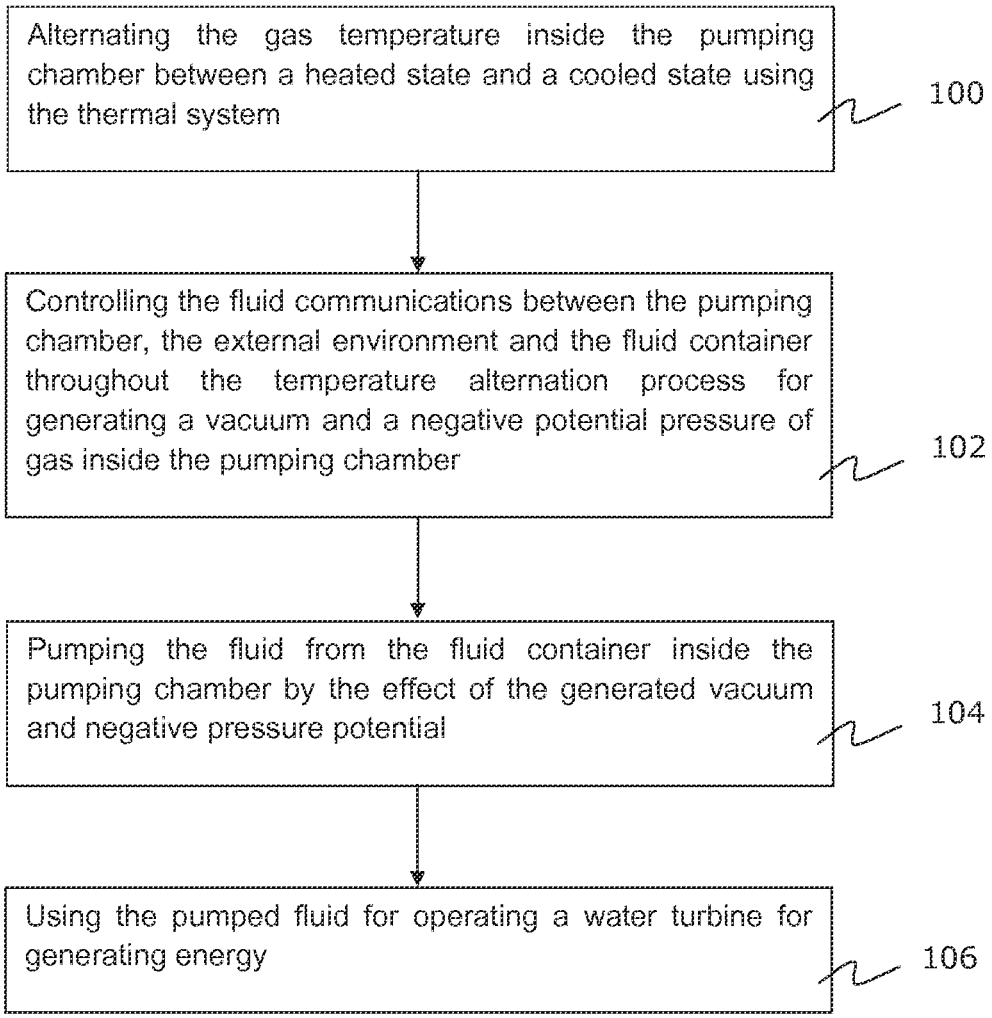
FIG. 6 is a flow chart showing a method of generating energy using the pumping system in accordance with one embodiment of the invention.

Referring to FIG. 6, there is also provided a method of generating energy using a water turbine, the method comprising using the method of pumping water from a fluid container in accordance with this invention for pumping fluid 40 from the fluid container 26 for operating the water turbine 50 for generating energy, the fluid being water in this case. More particularly, the method comprises: alternating the gas temperature inside the pumping chamber between a heated state and a cooled state using the thermal system 100, generating a vacuum and a negative potential pressure of gas inside the pumping chamber by the effect of the gas temperature alternation and by controlling the fluid communications between the pumping chamber, the external environment and the fluid container 102, and pumping fluid from the fluid container inside the pumping chamber by the effect of the generated vacuum and negative pressure potential 104, and using the pumped water for operating the water turbine for generating energy 106.

Example of Energy Generation Using a Fluid Pumping System Using a Solar Thermal System Water Pumping—Stage I: Air transfer outside the pumping chamber: As illustrated in FIG. 3A, during the day time, the air inside the pumping chamber 12 will be heated by the solar energy transmitted through the solar panels 19 to the blackbody 21. The pressure will increase inside the pumping chamber 12 pushing the first valve 20 and allowing it to open when the pressure inside the pumping chamber 12 exceeds the pressure of the external environment 22 (atmosphere in this case). This will result in mass transfer of the air through the first outlet port 14 and the first conduit 34 under the influence of the high temperature inside the pumping chamber 12 and the pressure difference between pressure inside the pumping chamber 12 and the pressure of the external environment 22 (as explained below). The high pressure inside the pumping chamber 12 which is higher than the atmospheric pressure outside will force the first valve 20 to open. The first valve 20 will remain open as long as the pressure inside the pumping chamber 12 is higher than the pressure of the external environment 22 which is the atmospheric pressure in this case, which would happen as long as the temperature inside the pumping chamber 12 is increasing.

Water Pumping—Stage 2: Cooling process and water lifting: During the night time or when the heat source is turned off, stage II will start. The gas temperature inside the pumping chamber 12 will cool down and the temperature of the remaining air will decrease and accordingly, the pressure inside the pumping chamber 12 will be decreased. As illustrated in FIG. 3B, when the pressure of the external environment 22 exceeds the pressure of the pumping chamber 12, the first valve 20 will be forced to close under the influence of the high pressure of the external environment 22. A negative pressure potential and vacuum will be therefore generated inside the pumping chamber 12 when the air temperature is cooled down. This will force the second valve 24 to open for allowing the water to be induced inside the pumping chamber 12 through the second conduit 36. The water will flow to the pumping chamber 12 through this second conduit 36 under the influence of the negative potential pressure inside the pumping chamber 12 (see details below).

Having the process of heating and then cooling of the air inside the pumping chamber 12 repeated, the water will be pumped continuously until the pumping chamber 12 is filled to the desired level. The pressure gauge 32 or the temperature gauge 30 might be used to control the process. The movement of the air is a worm-like movement. That is, there is only one way out through the first valve 20 during the heating process, and a negative pressure potential and a vacuum will be generated inside the pumping chamber 12 when the air is cooled down for inducing the fluid inside the pumping chamber 12.

Generating energy: After filling the pumping chamber 12, the fluid can be exhausted through the third conduit 40 to the water turbine for generating energy. The fluid flow can be controlled/regulated using the water flow switch 54. To allow the smooth flow of water, the air flow switch 37 can be opened. The air and water flow switches 37 and 54 should be opened or closed simultaneously; otherwise, air can flow inside the pumping chamber 12 from the third conduit 40 in the form of bubbles causing discontinuity in the flow. The third conduit 40 is in fluid communication with the water turbine 50 for using the exhausted water by the turbine 50 for generating electricity.

The fluid pumping system 10 can provide the following advantages:

a. The system can run on solar energy which would reduce or avoid cost in terms of energy related to water lifting.
b. The system can use pressure operable valves (20 and 24) which can be operable by the effect of the internal pressure and the atmospheric pressure, therefore avoiding use of an independent source of energy to operate these.
c. The system can be environmental friendly which can avoid use of toxic transmission of any kind.
d. The system can be very useful for pumping quickly certain fluids such as oil spills or contaminated pools or lakes.
e. The system can minimize and/or avoid maintenance once set up since the heating can be generated by a solar thermal system and the valves are operable by pressure effect.
f. The system can be noiseless, since it involves no generators or motors to pump water.

The mathematical foundations of the pumping system: The mathematical foundation behind this setup is the ideal gas law which relates the volume V, the pressure P, with the temperature T and the mass n and it is given by:

$$PV=nRT \tag{1}$$

In SI units, P is measured in pascals or atmospheric pressure (atm); V in cubic meters, n is the amount of substance of gas and it is measured in moles, T in Kelvin. The constant R is the ideal, or universal, gas constant, and it is equal to the product of Boltzmann's constant and Avogadro's constant and it has the value 8.314 $J \cdot K^{-1} \cdot mol^{-1}$.

Water Pumping—Stage 1—Reducing the mass of the gas inside the pumping chamber: Stage 1 starts with the following initial conditions: The pressure inside the pumping chamber is constant and it is equal to 1 atm i.e., $P_0$=1 atm. The volume of the container is fixed as well and it is equal to $V_0$. The inside temperature is $T=T_0$ and the amount of gas $n=n_0$. When the heating of the air inside of the pumping chamber 12 starts, the volume of the pumping chamber 12 is fixed. The pressure inside the pumping chamber 12 will increase but it will be always adjusted to be 1 atm because the first valve 20 is going to open under the influence of the increase in the pressure inside the pumping chamber 12 allowing certain amount of gas to leave the container. The ideal gas law then can be rewritten as:

$$n = \frac{PV}{RT} \tag{2}$$

Accordingly, the mass of the gas will decrease at the following rate:

$$\frac{dn}{dt} = -\frac{PV}{RT^2}\frac{dT}{dt} \tag{3}$$

Where $$\frac{dT}{dt}$$

is the rate of change of the temperature and $$\frac{dn}{dt}$$

is the rate of change of the mass of the gas. After sometime say $t=t_0$, the temperature reaches a certain value, say $T_1$ then integrating Eq. (3) with respect to time gives the following formula for the amount of gas remains in the container:

$$n_2 = n_0 - n_1 = \frac{PV}{R}\left(\frac{T_1 - T_0}{T_1 T_0}\right) \tag{4}$$

Water Pumping—Stage 2: Reducing the pressure inside the container: When stage 2 starts, the initial values are $V=V_0$, P=1 atm, $T=T_1$ and $n=n_1$. The first valve 20 is now closed (because no more heating) and assume also that the second valve 24 is closed. The temperature starts to decrease to reach the original temperature value $T=T_0$. The ideal gas law then can be written as:

$$P = \frac{nRT}{V} \tag{5}$$

And the pressure will start to decrease as long as the temperature decreases. The rate of change of the pressure is linearly proportional to the rate of decrease of the temperature and it is given by the following relation:

$$\frac{dP}{dt} = \frac{n_1 R}{V_0}\frac{dT}{dt} \tag{6}$$

The amount of change in the pressure when the temperature reaches $T_0$ is given by the following relation:

$$P_2 = P_0 - P_1 = \frac{n_1 R}{V_0}(T_1 - T_0) \tag{7}$$

Where $P_1$<1 atm.

Due to the pressure difference between the external environment (atmosphere) and the inside of the pumping chamber 12, the fluid 40 will flow inside the container forcing the second valve 24 to open and the first valve 20 to close.

How much water can be pumped (The volume change): While the temperature of the air inside the pumping chamber 12 decreases and the second valve 24 is open, the volume of the gas inside the pumping chamber 12 will be decreased according to the following formula:

$$\frac{dV}{dt} = \frac{n_1 R}{P}\frac{dT}{dt} \tag{8}$$

The change of volume when the temperature reaches $T_0$ will be given by the formula $$V_1 = \frac{n_1 R T_0}{P_0} \tag{9}$$

Where $V_1<V_0$. The vacuum generated by the shrinking of the air is therefore $$V_2 = V_0 - V_1 = \frac{n_1 R}{P_0}(T_1 - T_0) \tag{10}$$

Therefore, the amount of water to be pumped is the amount of water needed to fill in the vacuum $V_2$. It is worth mentioning here that the volume of the second conduit 36 is taken into account when making any of the above calculations.

It will be appreciated that the above description related to the invention by way of example only. Many variations on the invention will be obvious to those skilled in the art and such obvious variations are within the scope of the invention as described herein whether or not expressly or explicitly described.

The invention claimed is:

1. A fluid pumping system comprising:

a pumping chamber containing a gas and having a first outlet port at a location spaced from an operative lower end region of the pumping chamber and adapted to be in a first fluid communication with an external environment and through which the gas can pass, in use, from the pumping chamber to the external environment, the pumping chamber further having a first inlet port adapted to be in a second fluid communication with a fluid container from which a liquid is to be pumped into the pumping chamber, wherein the pumping chamber is further adapted to be in a thermal communication with a thermal system for alternating a gas temperature inside the pumping chamber between a heated state and a cooled state;

a first valve adapted to control the first fluid communication between the pumping chamber and the external environment; and a second valve adapted to control the second fluid communication between the pumping chamber and the fluid container;

wherein the pumping chamber and the valves are in fluid cooperation for controlling a vacuum generated by a reduction of a pressure of the gas inside the pumping chamber resulting from a mass of heated gas passing from the pumping chamber through the first outlet port and to the external environment and from alternation of the gas temperature when the gas passes from the heated state to the cooled state and from the controlling of the first and second fluid communications, wherein the vacuum generated inside the pumping chamber enables pumping of the liquid from the fluid container to an inside of the pumping chamber, and wherein the external environment is the atmosphere.

2. The fluid pumping system as claimed in claim 1, wherein the alternation of the gas temperature is conducted recursively through time.

3. The fluid pumping system as claimed in claim 1, wherein:

the first valve is a one-way valve adapted to operate automatically and to open only when a pressure inside the pumping chamber exceeds a pressure of the external environment for enabling the first fluid communication of the gas from the pumping chamber through the first outlet port to the external environment; and the second valve is a one-way valve adapted to operate automatically and to open only when the pressure inside the pumping chamber is below the pressure of the external environment for enabling the second fluid communication of the liquid from the fluid container to the pumping chamber through the first inlet port.

4. The fluid pumping system as claimed in claim 1, wherein the thermal system comprises a solar thermal system.

5. The fluid pumping system as claimed in claim 1, wherein the thermal system comprises an electrical thermal system.

6. The fluid pumping system as claimed in claim 1 further comprising a temperature gauge adapted to operate at a pre-set temperature for releasing heat from inside the pumping chamber for cooling down the gas when the pre-set temperature is reached inside the pumping chamber.

7. The fluid pumping system as claimed in claim 1 further comprising a first conduit adapted to be connected to the first outlet port and to the external environment for transporting the gas from the pumping chamber to the external environment.

8. The fluid pumping system as claimed in claim 1, further comprising a conduit adapted to be connected to the first inlet port and to the fluid container for transporting the liquid from the fluid container to the pumping chamber.

9. The fluid pumping system as claimed in claim 1, wherein the pumping chamber has a second outlet port in fluid communication with a conduit for exhausting the liquid pumped from inside the pumping chamber for external use, the system further comprising a pressure gauge for adjusting a pressure inside the pumping chamber during the exhaustion process, a fluid flow switch for regulating a flow of the liquid being exhausted and an air flow switch for introducing air to an inside the pumping chamber for facilitating the liquid exhaustion process.

10. A fluid turbine system for generating energy comprising, in combination:

a water turbine for generation of energy; and the pumping system as claimed in any one of claims 1 to 9;

wherein the pumping chamber of the pumping system is further adapted to be in a further fluid communication with the water turbine for directing a liquid pumped from the fluid container to the water turbine for operation, the liquid pumped being water.

* * * * *